US005598192A

United States Patent [19]

Burger et al.

[11] Patent Number: 5,598,192

[45] Date of Patent: Jan. 28, 1997

[54] THERMAL INK JET PRINTHEAD WITH EXTENDED PRINT CAPABILITY

[75] Inventors: William R. Burger, Fairport; Steven R. Moore, Rochester; Gary A. Kneezel, Webster, all of N.Y.

[73] Assignee: Xerox Corporation, Stamford, Conn.

[21] Appl. No.: 485,065

[22] Filed: Jun. 8, 1995

[51] Int. Cl.[6] ..... B41J 2/145; B41J 2/15; B41J 2/21

[52] U.S. Cl. ..... 347/43; 347/40

[58] Field of Search ..... 347/43, 40, 41, 347/86

[56] References Cited

U.S. PATENT DOCUMENTS

| | | | |
|---|---|---|---|
| 4,463,359 | 7/1984 | Ayata et al. | 346/1.1 |
| 4,774,529 | 9/1988 | Paranjpe et al. | 347/43 |
| 4,908,638 | 3/1990 | Albosta et al. | 347/43 |
| 5,371,531 | 12/1994 | Rezanka et al. | 347/43 |

*Primary Examiner*—Benjamin R. Fuller
*Assistant Examiner*—Thinh Nguyen

[57] ABSTRACT

An ink jet printer includes a printhead having a plurality of segments each having ink ejecting nozzles, each segment supplied with ink of a different characteristic. Means are provided for moving the printhead in a direction transverse to the advancing movement of a recording medium. Means are further provided for moving the printhead between two or more positions along the recording medium advance direction. Thus, the printhead can print a swath of ink of a first characteristic from one segment and then be moved to print a second swath from a second segment with ink of a second characteristic. In one embodiment, a printhead has two segments, one printing in black, and the other in color. A shift mechanism is enabled to move the printhead between a black print position and a color print position. The invention contemplates alternate color printing swaths at alternate printing positions along the same printing swath, or a combination thereof.

11 Claims, 5 Drawing Sheets

THERMAL INK JET PRINTHEAD WITH EXTENDED PRINT CAPABILITY

BACKGROUND OF THE INVENTION

The present invention relates to a thermal ink printer and, more particularly, to a novel printhead which extends the printing range perpendicular to the process direction by selective shifting of the printhead. In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves in the process direction across a print sheet numerous times in swaths, much like a typewriter; alternatively, a printhead, which consists of an array of ejectors extending the full width of the print sheet, is incorporated into what is known as a "full-width array" (FWA) printer. When the printhead and the print sheet are moved relative to each other, imagewise digital data is used to selectively activate the thermal energy generators in the printhead over time so that the desired image will be created on the print sheet.

With ink-jet printing, it is also possible to create multicolor images on a print sheet. This type of printing may be used for full-color images, such as to reproduce a color photograph, or can be employed for "highlight" color, in which colored additions are made to a main portion of the image or text, which is typically black. In either case, the most common technique for color ink jet printing has been to sequentially image two or more colors, in separate printing steps, onto the single print sheet. This superimposition can be carried out in any number of ways. For example, a single printhead may be segmented with different colinear sections of the printhead dedicated to different colors, so that the different colors are printed in subsequent passes, with a paper advance between passes. Alternately, two or more printheads may be positioned very close and substantially parallel to each other, and render the two or more portions of the image onto the print sheet almost simultaneously, although different areas of the print sheet will be printed upon by the different printheads at the same time or with a small time lag. For a full-color process image, four types of ink (yellow, magenta, cyan, and black) may be emitted from four separate printheads during printing as the print sheet is moved relative to them.

The above black and color printers are designed to accommodate a print zone having the same width as the length of the printhead; e.g., a printhead with 64 jets, 128 jets, 256 jets, etc. For many machines, a relatively small print zone (swath) is used in order to maintain a small gap (typically 1 mm or less) between the nozzle surface and the print sheet. Control of such a gap is most easily achieved by limiting the size of the print zone. This results in various use restrictions. For example, if a user wishes to change the drop size characteristics of a black only printhead to achieve gray scale printing, or different optical density for different media (such as paper versus transparencies), a different black printhead with the appropriate drop size must be substituted or added as a second printhead. In the earlier cited example of a segmented colinear color printhead, the printing throughput is reduced relative to a monochrome printhead of the same size, because fewer jets are available for each color. It would be advantageous for these and for other printer applications discussed in further detail below to have both color and black printing capabilities, or different drop size printing capabilities, coresident in the printer without a throughput loss and using only a relatively small print zone for printing, and further without the need for an expensive machine having a larger, or containing multiple, printheads.

SUMMARY OF THE INVENTION

It is an object of one embodiment of the present invention to increase the printing characteristics of a single printhead.

It is a further object to enable a single printhead to print in a first and second color.

It is another object to select and print either black or color from a single printhead.

It is a still further object to overprint black and color via unidirectional or bidirectional printing.

It is another object to alternate between black and color within the same print swath.

It is another object to select between different drop sizes from a single printhead.

These, and other objects, are realized by utilizing a print cartridge with an extended segmented printhead. The printhead has at least two segments, each segment associated with ejecting ink of a selected characteristic, e.g., density, color and/or droplet size. The printhead is adapted to be toggled or moved up and down in the paper advance direction (direction of movement of the recording medium) to align the appropriate segment of the printhead in the printing zone. More particularly, the invention relates to an apparatus for printing an image along a process direction and onto a recording sheet movable transverse to the process direction, the apparatus comprising:

a print cartridge movable in the process direction, the cartridge comprising a segmented printhead with each segment adapted to eject ink of a characteristic different from the other segments along a printing swath in the process direction, the cartridge further including ink reservoirs for supplying ink of the appropriate characteristic to the printhead segments in response to input image signals and means to selectively move the printhead back and forth transverse to the process direction to selectively position one of the printhead segments to print along said printing swath.

DESCRIPTION OF THE INVENTION

Figure 1:
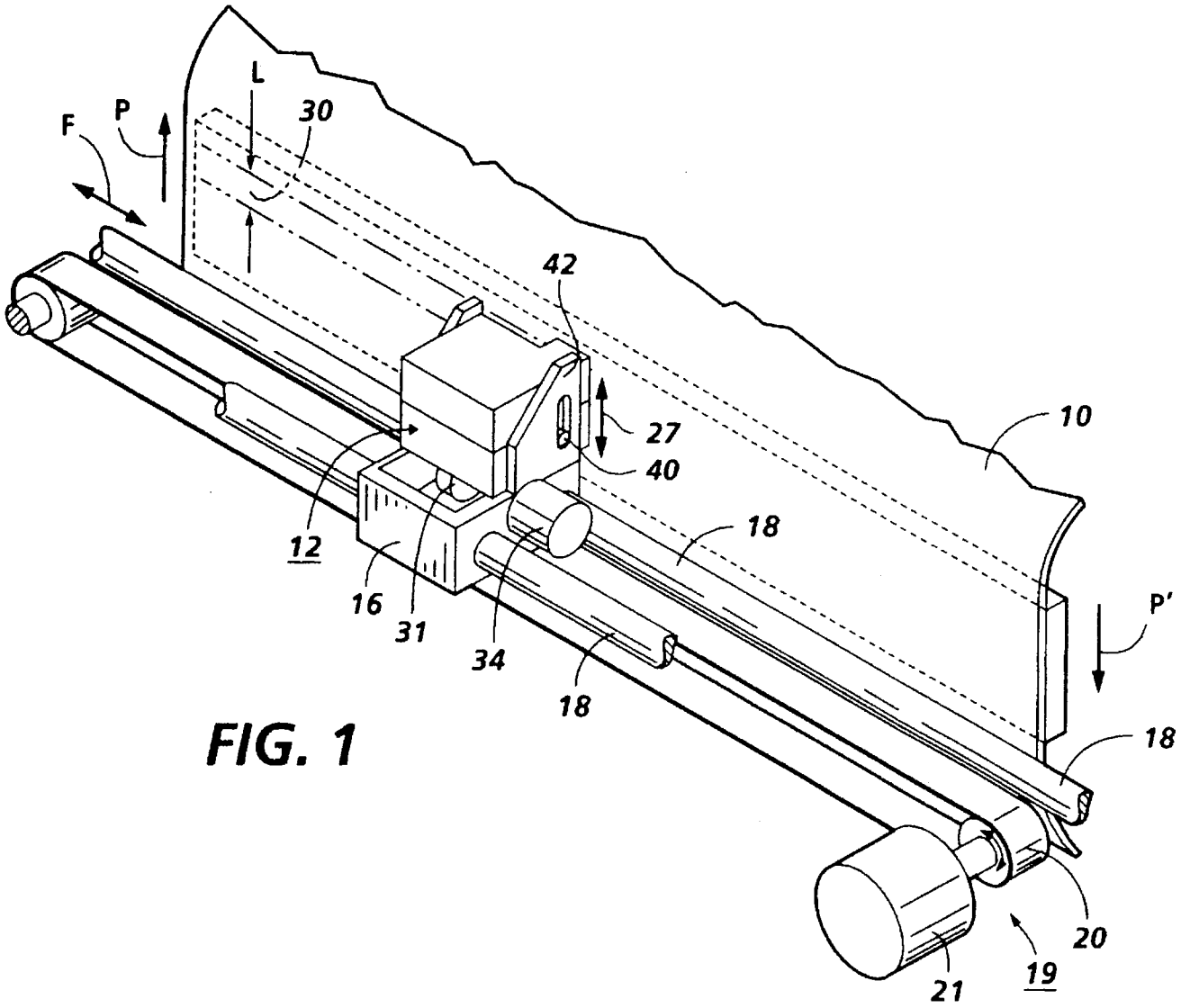
FIG. 1 is an elevational view of a portion of a thermal ink jet printer showing a multi-segmented printhead having a black and color segment movable between two printing positions.
Figure 2:
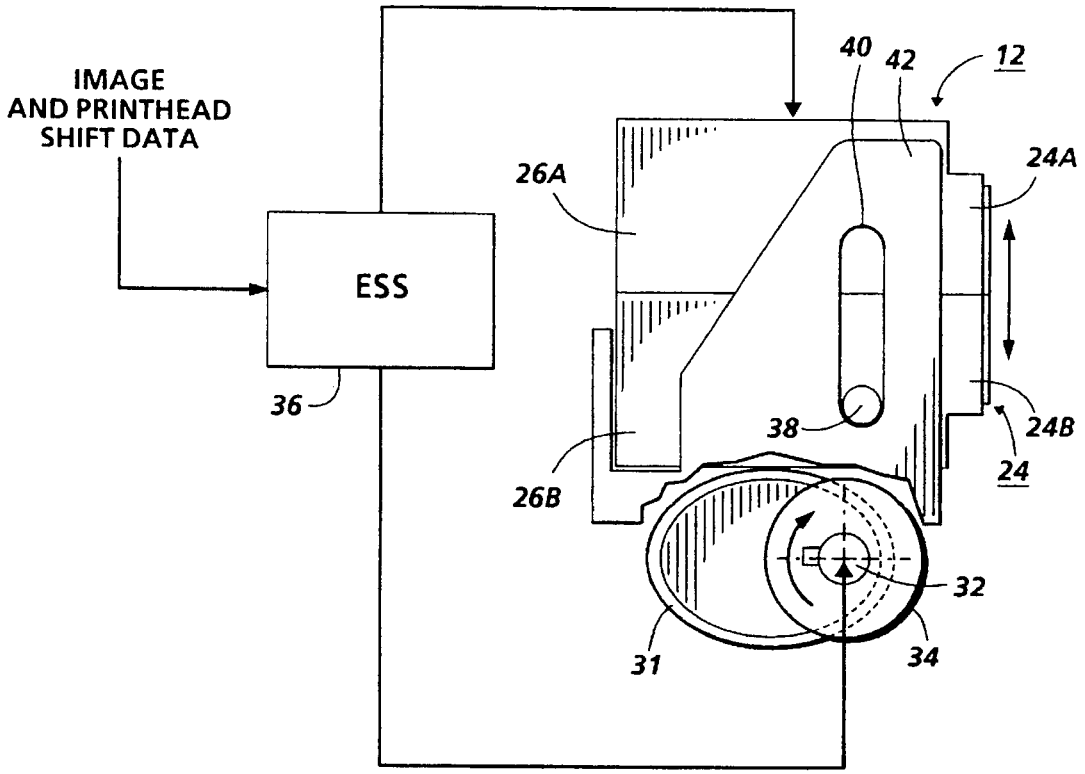
FIG. 2 is an end view of the printer of FIG. 1 showing a mechanism for changing the position of the print cartridge along the paper advance direction.

FIG. 1 is a simplified elevational view of a portion of a drop-on-demand thermal ink jet printer. A recording sheet 10 is indexed in a paper advance direction P by means known in the art until it comes into position relative to a printhead station comprising, in a first embodiment, a printhead assembly 12 which is mounted on a carriage 16. The carriage 16 is mounted in such a way that the printhead assembly 12 may be caused to reciprocate relative to the sheet 10 in a fast-scan or process direction, indicated as F, which is preferably transverse to the paper advance direction P. In order to carry out this motion, carriage 16 may be mounted on guide rails 18, and driven by a carriage drive system 19 comprising timing belt 20 and motor 21, to create a back-and-forth (F) motion of carriage 16. One mechanism for moving a printhead assembly is disclosed in U.S. Pat. No. 5,371,531, whose contents are hereby incorporated by reference. Various related and other schemes for causing the reciprocating motion of carriage 16 in a fast-scan process direction relative to the sheet 10 are familiar to the art of ink-jet printers, and any known method may be employed to create this scanning motion.

Figure 3A:
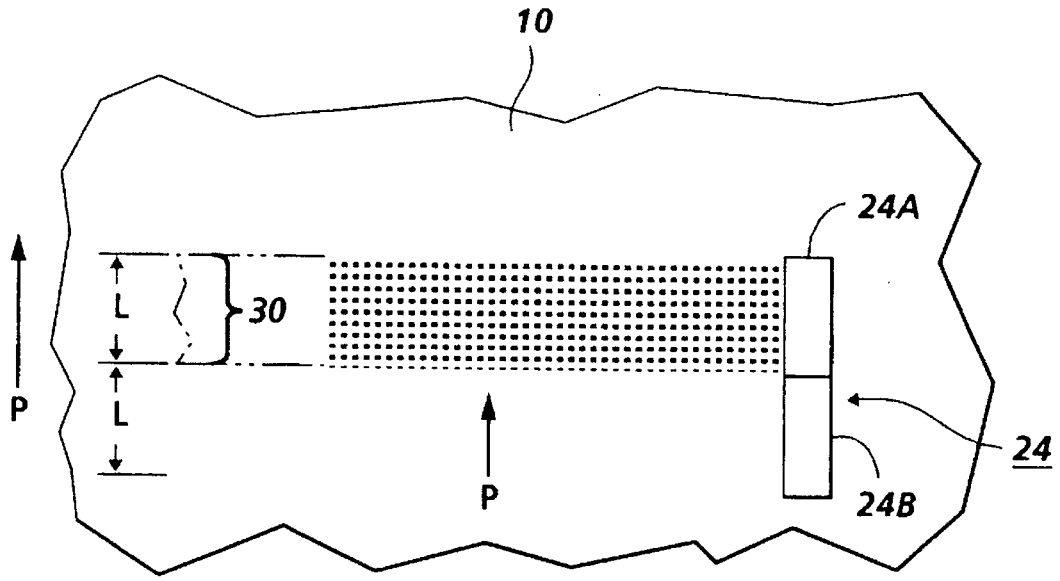
FIGS. 3A and 3B are front views of the segmented printhead of FIG. 1 showing the printhead in two possible positions printing along the same swath.
Figure 3B:
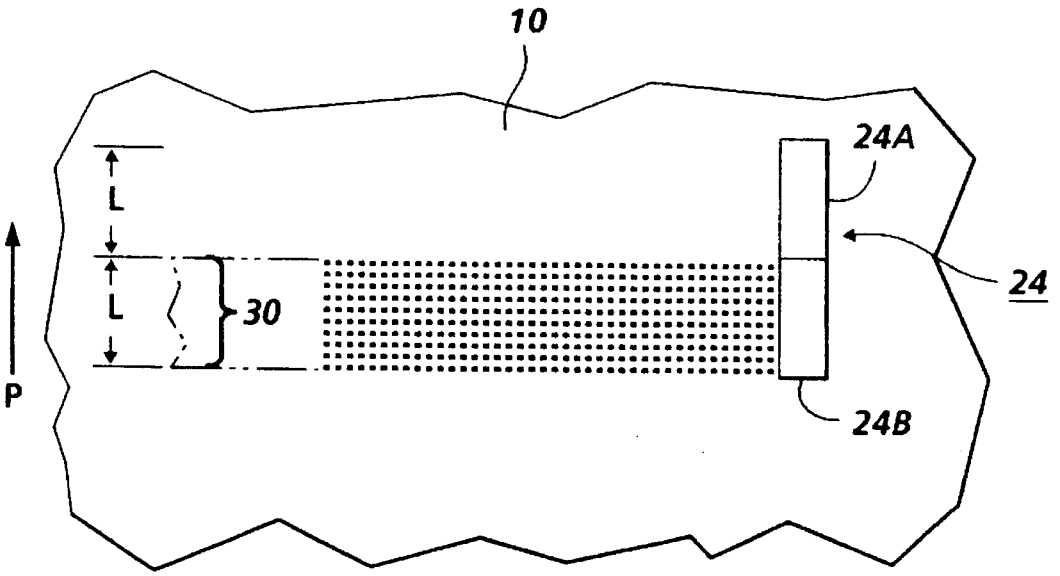

Turning now to a more detailed description of printhead assembly 12, and referring to FIGS. 1, 2 and 3A, 3B, the printhead assembly 12 includes a single printhead 24 having a first segment 24A and a second segment 24B. Each segment contains a linear array of drop-on-demand thermal ink jet nozzles. As shown in FIGS. 3A, 3B, printhead segments 24A, 24B have an equal length measured along the paper advance direction. Thus, for embodiments in which the nozzles have the same spacing in the different segments, the number of nozzles on each segment are equal. For embodiments having different resolutions in the different segments, the number of nozzles scales with respective resolutions. Each printhead segment is supplied with ink from an associated ink reservoir housed in a cartridge. Printhead segment 24A, for this first embodiment, is supplied with black ink from reservoir 26A while printhead segment 24B is supplied with a color ink (magenta for this example) from reservoir 26B. Thus, printhead assembly 12 is seen to comprise a printhead 24 with two segments 24A, 24B with associated ink cartridges 26A, 26B, respectively. Image processing means (not shown but conventional in the art) are used to selectively energize heaters in the printhead ink channels and propel ink droplets from the nozzles of each printhead segment on demand in response to digital input data. U.S. Pat. No. Re. 32,572 discloses details of a heater energization circuitry which can be used for this selective heater energization; the contents of this patent are hereby incorporated by reference.

According to the invention, printhead 24 is adapted for selective movement along the paper advance direction P and reverse paper advance direction P', so as to position either printhead segment 24A or 24B in position to print along a print swath 30. Swath 30 is shown in FIGS. 1 and 3A, 3B to have a height L. In one embodiment, this toggling or repositioning motion is provided by the cam arrangement shown in FIGS. 1 and 2. Referring to these figures, an eccentric cam 31 is mounted on shaft 32 of servo motor 34. Motor 34 is controlled by signals from ESS 36 which receive binary image data signals from a computer, scanner or other data source and process the information converting it into appropriate signals for operating the printer. These operations include sending signals for driving drive system 19 to enable a fast scan motion of the print cartridge and electrical signals to the printhead to energize the heaters associated with the nozzles to be fired. Signals from the ESS also control operation of servo motor 34 energizing the motor and causing the cam 31 to rotate in a clockwise direction. Printhead assembly 12 is thus movable in the paper advance or reverse paper advance direction. The assembly has a projection 38 which is movable within a key 40 formed in a side frame 42 of the assembly.

As shown in FIG. 3A, printhead 24 has a first segment 24A which prints in black. Segment 24B prints in magenta. The printing will occur in the fast scan direction F along printing swath 30. FIG. 3A shows the printhead in the position wherein black segment 24A is in position to print along swath 30.

A particular mode is controlled by inputs processed by ESS 36. Several modes of print operation are possible with this configuration.

1. An all black print operation may be performed in which an entire sheet is printed in black only. For this conventional mode, the printhead is not moved in the paper advance direction and stays in the position shown in FIG. 3A.

2. An all magenta print operation may be performed in which the entire sheet is printed in magenta. For this mode, cam 30 is caused to rotate moving printhead assembly 12 in the paper advance (P) direction. The assembly moves so as to position the segment 24B in the printing position shown in FIG. 3B. The printing operation continues with the sheet being printed in magenta.

3. A highlight color operation is enabled by printing a swath in black; then moving the printhead a distance L in the paper advance direction (from position FIG. 3A to position shown in FIG. 3B) and printing the next swath in magenta, either in a unidirectional or bidirectional mode. Further swaths can be printed with either black or color with the printhead being moved as appropriate; e.g. moved in a reverse paper advance (P') direction if the sequence is from magenta to black.

4. A variation of a highlight color print operation may be enabled by repositioning the printhead from position 3A to position 3B during a printing swath. Thus, part of a swath may be printed in black, the printhead then moved to the position of FIG. 3B, the next section in magenta, the printhead repositioned to the FIG. 3A position, and the third section in black and so on.

The invention contemplates a wide range of usage with combinations of the operational modes described in 1, 2, 3 and 4 above.

Figure 4A:
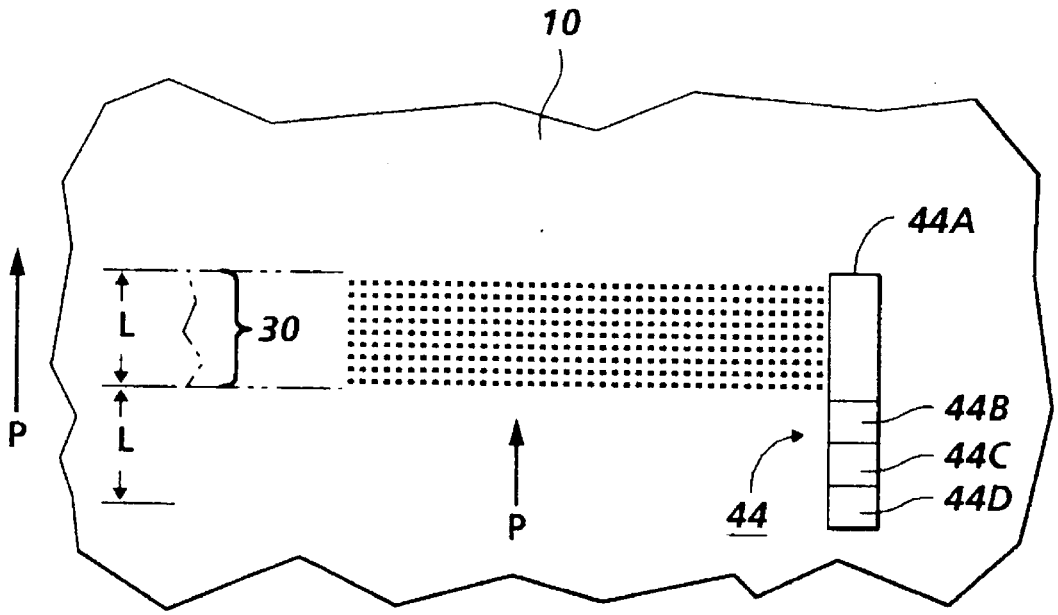
FIGS. 4A and 4B are front views of a second embodiment of a segmented printhead which comprises two segments of equal length, one segment printing in black, the other segment printing in multicolors.
Figure 4B:
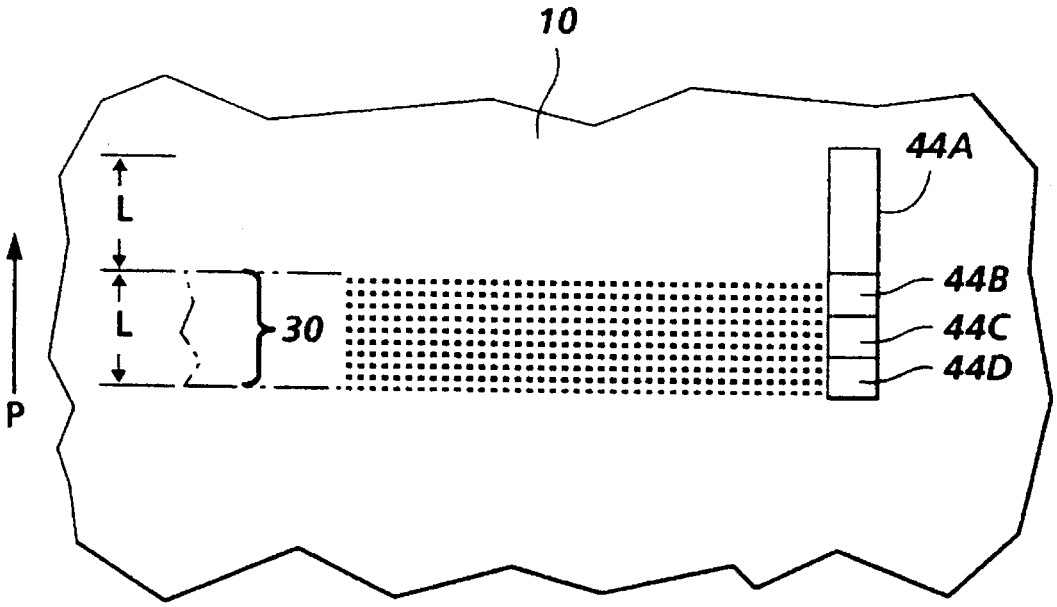

FIGS. 4A, 4B illustrate another embodiment of the invention wherein assembly 12 comprises a printhead 44 which includes a black segment 44A and three segments, 44B, 44C, 44D, each associated with a different color (cyan, magenta, yellow). For this embodiment, the length L of the black segment equals the combined lengths of the three color segments, e.g., each color segment would have a length of L/3. Printhead assembly 12, for this embodiment, has a black and three color ink reservoirs fluidly connected to each printhead segment. Operation is as described for the FIGS. 3A, 3B embodiment with the printhead 44 being selectively moved from the FIG. 4A position to the FIG. 4B position to enable full color operation. Sheet 10 is moved an incremental distance L/3 in the process direction. Alternately, the printhead could be made up of three or more equal segments, and each segment positioned by partial rotation of cam 30.

Other variations of the above embodiments can be provided consistent with the purposes of the present invention. For example, in the FIG. 3 embodiment, segment 24A can provide a black ink of a first spot size on the media while segment 24B can provide a black ink of a second spot size on the media. To enable this embodiment, the ink drop ejector characteristics are constructed differently for each printhead segment to produce different drop sizes. This embodiment enables a gray scale printing mode by moving between the two printhead segments during a page printing operation. It also enables different printing densities for different media, such as paper versus transparencies. Different nozzle spacings can optionally be used in the two segments.

Thus, different characteristics of each printhead segment can include the size and spacing of ink nozzles to change the ejected droplet size, e.g., the "characteristic" for this usage would be the drop diameter. The "characteristic" can also include the density (dye or pigment concentration) of the ejected ink as well as the color.

Figure 5:
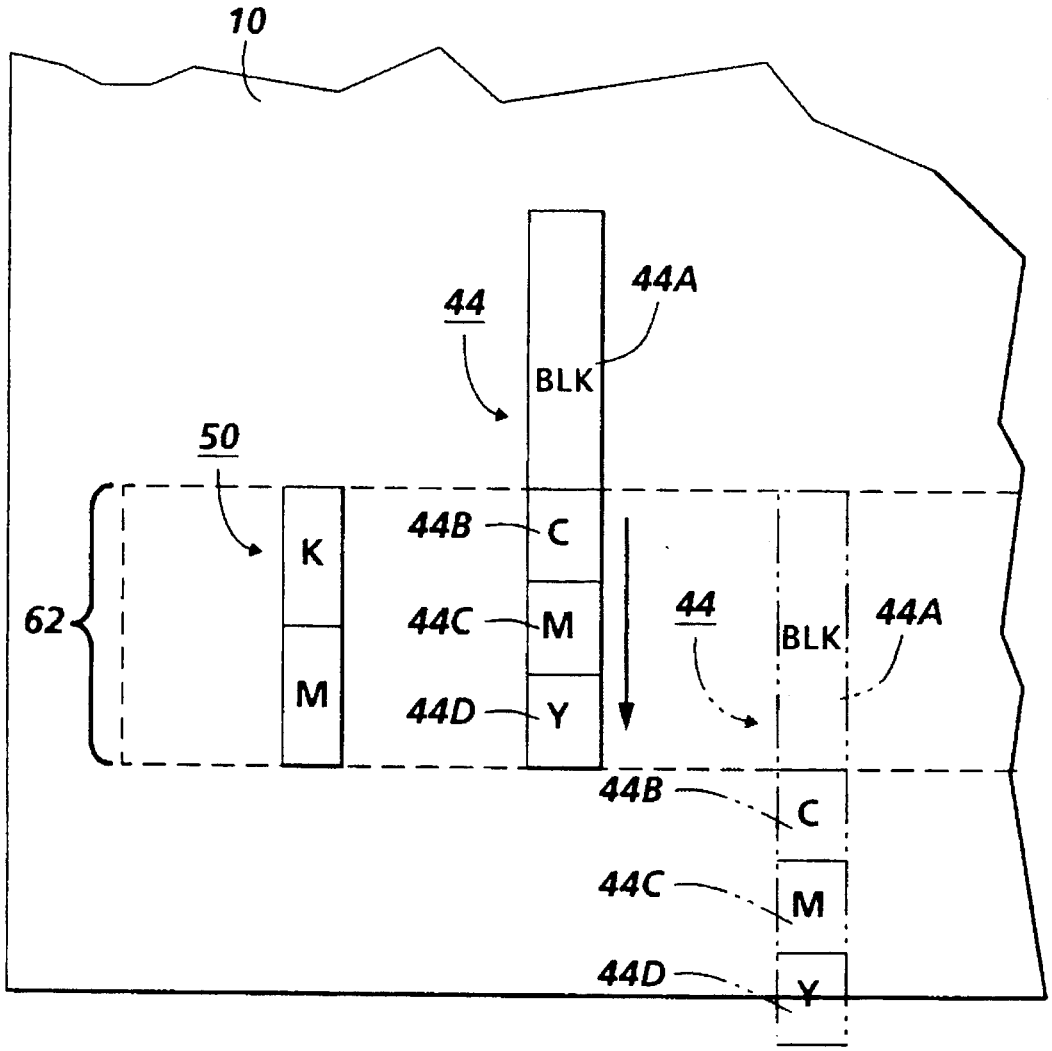
FIG. 5 illustrates an advantage of the printhead of FIG. 4 for printing color segments at the bottom of a sheet compared with a prior art printhead.

One particular advantage of the invention is to maximize full printing capability by printing on all usable space on the sheet. One problem inherent for prior art printers using segmented color printheads in printing onto cut sheets advanced into a print zone is accurately holding the paper near the bottom or trail edge of the sheet in a color printing mode. Consider the situation shown in FIG. 5; sheet 10 has been printed and is near the end of the usable sheet space. If a conventional two segment printhead 50 is in use, the printhead is fixed in position so that printing a final swath 62 is constrained since color printing cannot be accomplished within the swath. However, using the printhead configuration of FIG. 4 as shown in FIG. 5, it is seen that swath 62 can be fully utilized to print either color (the solid line configuration) or black (the dotted line configuration).

While the embodiments disclosed herein are preferred, it will be appreciated from this teaching that various alternative modifications, variations or improvements therein may be made by those skilled in the art which are intended to be encompassed by the following claims:

We claim:

1. An apparatus for printing an image along a process direction and onto a recording sheet movable to the process direction, the apparatus comprising:

means for providing input image signals;

a printhead assembly including a single printhead having at least a first and second segment, said first and second segment aligned one above the other, in the transverse process direction, with said at least first segment adapted to eject ink of a characteristic different from the said at least second segment along a printing swath in the process direction, the assembly further including ink reservoirs for supplying ink to said first and second segment of the printhead in response to said input image signals; and means to selectively move the printhead assembly back and forth transverse to the process direction to selectively position one of said first and second segment of the printhead to print along said printing swath.

2. The apparatus of claim 1, wherein the printhead has two segments of equal length L in the process direction.

3. The apparatus of claim 2, wherein one segment is supplied with black ink of a first density and the second segment is supplied with black ink of a second density.

4. The apparatus of claim 2, wherein one segment ejects black ink drops of one size, and the second segment ejects drops of a different size.

5. The apparatus of claim 2, wherein each segment contains a linear array of nozzles, the nozzles in one segment eject ink to form images of a first resolution, and the nozzles in the second segment eject ink to form images at a second resolution.

6. The apparatus of claim 2, wherein one segment is supplied with black ink and the second segment is supplied with ink of at least one other preselected color.

7. The apparatus of claim 2, wherein one of the segments is supplied with a plurality of color inks of a first set of densities or hues and the second segment is supplied with a plurality of color inks of a second set of densities or hues.

8. The apparatus of claim 2 wherein one of the segments ejects ink drops of a first spot size and the second segment ejects ink drops of a second spot size.

9. The apparatus of claim 2 wherein one of the segments ejects ink drops at a first resolution and the second segment ejects ink drops at a second resolution.

10. The apparatus of claim 1, wherein the printhead has a first die of length L and a second die butted to the first die, the second die comprising three segments, the first die supplied with black ink and each segment of the second die supplied with ink of a different color.

11. An improved ink jet printer having a printhead cartridge mounted on a reciprocating carriage which traverses or width of a recording medium forming an image along a printing swath, the printer including means for stepping the recording medium a predetermined distance after each traversal of the carriage across the width of the recording medium, the improvement wherein the cartridge includes a printhead with plural segments of equal length aligned one above the other in a direction transverse to a process direction, each segment providing a different printing characteristic, the printer including means for shifting the printhead in the transverse direction to selectively position one of the segment of the printhead printing along the print swath.

* * * * *